US005785171A

United States Patent [19]

Howes

[11] Patent Number: 5,785,171

[45] Date of Patent: Jul. 28, 1998

[54] PRIZE DELIVERY SYSTEM

[76] Inventor: James P. Howes, 122 St. Johns Rd., Wilton, Conn. 06897

[21] Appl. No.: 887,150

[22] Filed: Jul. 2, 1997

[51] Int. Cl.[6] ..... B65D 85/08

[52] U.S. Cl. ..... 206/232; 206/216; 206/459.5; 206/831; 239/33

[58] Field of Search ..... 206/216–218, 206/232, 457, 459.5, 831; 239/33

[56] References Cited

U.S. PATENT DOCUMENTS 4,911,320 3/1990 Howes ..... 206/217
5,056,659 10/1991 Howes et al. ..... 206/217
5,076,433 12/1991 Howes ..... 206/217
5,482,158 1/1996 Plester ..... 206/217

*Primary Examiner*—Jimmy G. Foster
*Attorney, Agent, or Firm*—Melvin I. Stoltz

[57] ABSTRACT

By employing the present invention, a delivery system comprising drinking straws as a holder or instrument for secretly retaining a prize award is realized. The drinking straws of the present invention are randomly intermixed with conventional non-prize bearing drinking straws, thereby being incapable of detection prior to opening the cover or holder associated therewith. In this way, prize awards such as cash and/or miniature models of prizes being won are secretly hidden and randomly distributed to lucky customers who instantly win the prize award.

17 Claims, 2 Drawing Sheets

PRIZE DELIVERY SYSTEM

TECHNICAL FIELD

This invention relates to prize delivery systems and, more particularly, to a prize delivery system wherein prizes can be randomly distributed to consumers without being discovered prior to opening.

BACKGROUND ART

The use of various promotional enhancements for increasing the sales of particular products is commonly employed by manufacturers or distributors for a wide variety of products. These promotional enhancements take on a variety of forms, all for the purpose of increasing product sales.

One of the promotional methods often employed by manufactures of products is to include a prize in either every product container or in selected containers. Although this promotional method has been successful with companies who distribute products, promotional concepts of this nature have been incapable of being employed in the sale or distribution of products which are placed in the container at the time of sale. Products of this nature are typically food products, such as beverages, ice cream,pop corn, and fast foods which are wrapped or placed in containers at the time of purchase.

In order to attain greater market share and sales increases in the food service industry, various promotional techniques have been developed. Typically, contests are conducted in which coupons are given out to customers in an attempt to increase overall product sales and attract customers to patronize the food distribution outlet or chain. In addition, in order to promote certain product sales, promotional contests or games have been employed which focus on a particular product, such as beverage purchases, wherein labels are affixed to the outside surface of drinking cups.

In order to achieve greater market share and/or product sales, various entities in the food service industry have attempted to find increasingly unique promotional techniques which generate added sales for their particular products. In doing so, the premium or prize type promotions have progressed from inexpensive give-aways, which are handed out to customers with any purchase, to expensive prize awards which are won by collecting numerous components of a final multi-part coupon or ticket. In this way, numerous repeated visits to the food provider are required before any individual would be able to win a valuable prize.

Recently, a unique marketing approach was developed wherein actual cash awards are secretly retained in food product containers for wet or moist products such as soda, water, beer, milk, yogurt and the like. This invention is disclosed in U.S. Pat. Nos. 4,911,321, 5,056,659, and 5,056,681. A nation-wide promotion was conducted employing the teaching of these patents and over-whelming consumer excitement and commercial success was realized.

Prior to the present invention, however, the food service industry was incapable of enjoying the substantial commercial success realized by employing the invention disclosed in U.S. Pat. Nos. 4,911,321, 5,056,659, and 5,056,681 due to the on-site delivery of food products in holders or containers as opposed to pre-packaged containers, upon which the constructions detailed in U.S. Pat. Nos. 4,911,321, 5,056,659, and 5,056,681 are based. As a result of this inability, the food service industry has been unable to enjoy an overwhelmingly effective and highly successful product sales incentive which generates substantial interest, customer identification, and increased purchases.

Consequently, it is a principal object of the present invention to provide a prize delivery system for use in the food service industry in connection with the sale of any desired food products, particularly food products prepared and delivered on site.

Another object of the present invention is to provide a prize delivery system having the characteristic features described above which comprises a holder or instrument for use with food products which is identical in all respects to typical holders or instruments, but which secretly contains a hidden prize award.

Another object of the present invention is to provide a prize delivery system having the characteristic features described wherein the prize bearing holder, or instrument is completely indistinguishable from non-prize bearing holders, or instruments, thereby preventing advance discovery of the existence of prize award contained therein.

Another object of the present invention is to provide a prize delivery system having the characteristic features described above wherein the prize bearing holder, or instrument is indistinguishable from non-prize containers, holders, and instruments such that both can be distributed to retain outlets with complete assurance that the prize bearing holder, or instruments cannot be detected when compared to non-prize bearing holders, or instruments.

A further object of the present invention is to provide a prize delivery system having the characteristic features described above which enables a highly effective promotional technique to be employed in the food service industry for substantially increasing sales while directly awarding the purchasing public with prize awards that are completely randomly distributed.

Other and more specific objects will in part be obvious and will in part appear hereinafter.

SUMMARY OF THE INVENTION

By employing the present invention, all of the difficulties and drawbacks found in the prior art are overcome and a unique delivery system is realized for enabling the food service industry to provide a promotional vehicles. In the present invention, the prize delivery system comprises holders or instruments normally employed in delivering desired food products for consumption. These delivery systems are specially constructed to secretly retain a prize award, while being completely indistinguishable from non-prize bearing holders or instruments.

In the present invention, the delivery system comprises drinking straws as the holders or instruments for secretly retaining the prize award and enabling prize bearing drinking straws to be randomly intermixed with conventional non-prize bearing drinking straws, with the prize bearing drinking straws being incapable of detection prior to opening of the cover or holder associated therewith. In this way, lucky consumers who find a prize award secretly retained in a drinking straw become instantaneous winners, without being required to make numerous repeated visits to the food service outlet or to collect a plurality of coupon elements in the hopes of winning a prize in the future. As a result, substantially increased excitement and interest is generated by providing instantaneous results to the consumers in an environment in which such results were unattainable.

Since the prize bearing drinking straws of the present invention are indistinguishable from non-prize bearing drinking straws, no amount of external analysis by consumers or employees will be sufficient to enable the discovery of which straws are actually prize bearing straws.

Consequently, the prize bearing straws are easily randomly distributed with non-prize bearing straws with complete assurance that prize bearing straws cannot be purposefully selected by either a consumer or an employee. Instead, the random distribution of prize bearing straws with non-prize bearing straws assures that winning customers are completely random and not preselected or purposefully achieved.

By employing the prize delivery system of the present invention, any soft drink employed in the food industry can be distributed with a straw system of the present invention so that each and every customer has the possibility of receiving a prize award secretly retained in the straw. If desired, pre-selected purchases can be targeted for promotion by including a straw system with each purchase even if a drinking straw is not required.

Preferably, by employing the present invention, cash awards of various denominations are employed as the principal prizes. However, other prize awards can be employed, without departing from the scope of the invention. As a result, a highly effective, consumer-motivating promotion is attained wherein consumers immediately win the actual monetary award, or other prize, by merely purchasing a food product. The consumer excitement developed by being a winner and immediately receiving a cash award or other prize, causes overwhelming consumer excitement and interest in repeatedly participating in the give-away promotion.

The invention accordingly comprises an article of manufacture possessing the features, properties and the relation of elements which will be exemplified in the articles hereinafter described and the scope of the invention will be indicated in the claims.

THE DRAWINGS

For a fuller understanding of the nature and objects of the present invention, reference should be had to the following detailed description, taken in connection with the accompanying drawings, in which.

DETAILED DESCRIPTION

By referring to FIGS. 1–10, along with the following detailed disclosure, the construction of the preferred embodiments of the present invention can best be understood. However, as is apparent from this disclosure, alternate constructions can be made without departing from the scope of the present invention. Consequently, the embodiments detailed in FIGS. 1–10 are provided as examples of the delivery system of the present invention and are not intended to limit the present invention to the specific embodiment disclosed.

Figure 1:
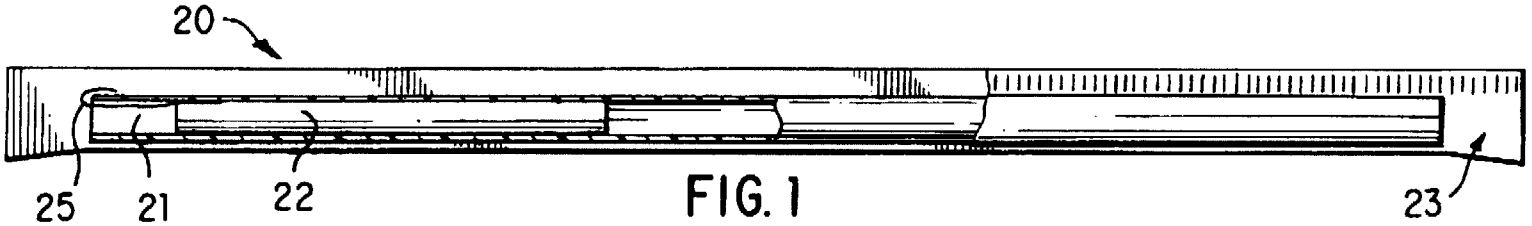
FIG. 1 is a top plan view, partially broken away and partially in cross-section, showing one embodiment of the prize delivery system of the present invention in the form of a drinking straw mounted within an outer closure/container.
Figure 2:
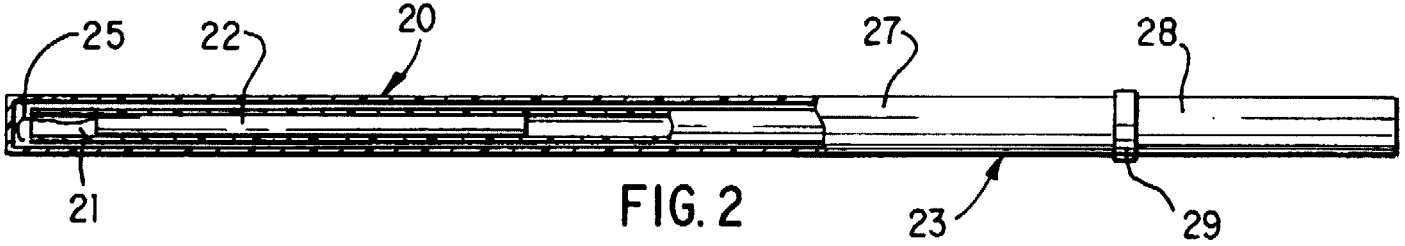
FIG. 2 is a top plan view, partially broken away and partially in cross-section, of an alternate embodiment of the prize delivery system of the present invention depicting a drinking straw mounted within an alternate construction for an outer closure/container.

In FIGS. 1 and 2, two alternate embodiments of prize delivery system 20 of the present invention are depicted. In each of these embodiments, prize delivery system 20 comprises a drinking straw 21, a prize award 22 secretly retained within drinking straw 21, and an outer closure or container 23 for drinking straw 21 and prize award 22.

Although prize award 22 may comprise any desired indicia bearing notice or prize related item, in the preferred embodiment, prize award 22 comprises a cash currency award of any desired denomination. Preferably, prize awards comprising a cash award ranging between $1 and $500 are preferred. Although any desired denomination of currency can be employed, as well as any alternate prize award, it has been found that by providing a cash prize award, consumer excitement over the instantaneous winning of a prize is substantially increased and enhanced.

In both the embodiment shown in FIGS. 1 and 2, prize award 21 is rolled and inserted into one end of straw 21 for being frictionally engaged with the interior wall thereof. If desired, food grade adhesive means can be employed in order to assure secure retention of prize award 22 within straw 21. The use of adhesive means eliminates any possibility that prize delivery system 20 would be manipulated, such as by being axially shaken, in order to determine the presence of prize award 22. By employing adhesive means to securely retain prize award 22 in contact with straw 21, prize award 22 is retained in position and any manipulation of delivery system 20 will not dislodge prize award 22 from its secured position.

In the preferred embodiment, delivery system 20 also incorporates a removal member 25, with one end thereof securely affixed to prize award 22 and extending out of the terminating end of straw 21. In the embodiment shown in FIG. 1, the opposed end of removal member 25 is merely wrapped around onto the outside wall of straw 21 to be easily accessed by the consumer once straw 21, with prize award 22 retained therein, is removed from outer closure/container 23.

By employing removal member 25, easy access and controlled removability of prize award 22 is easily attained. Although removal member 25 may comprise a plurality of alternate forms or constructions, removal member 25 comprises one selected from the group consisting of elongated strips of string, foil, tape, plastic, metal, cardboard, heavy paper, and the like. By employing removal member 25, once straw 21 has been removed from outer closure/container 23, a consumer immediately sees the presence of removal member 25. Upon pulling the accessible end of removal member 25, the consumer quickly and easily withdraws prize award 22 from straw 21, thereby immediately revealing the prize that has been won.

If the prize employed is a bill of U.S. currency, the winning consumer is capable of attaining immediate, instantaneous access to the actual prize that has been won. The immediate, instantaneous awarding of currency to lucky consumers has been found to produce a high degree of excitement and enhanced interest in the promotion, as well as in repeat visits to the retail outlet in an attempt to win additional prize awards.

If a food grade adhesive is employed to secure prize award 22 to the inside wall of straw 21, the incorporation of removal member 25 provides further assurance that the prize award is removed from the secured location in a complete and orderly manner. As a result, the incorporation of removal member 25 is highly desirable in assuring complete dislodgement of prize award 22 from straw 21.

Furthermore, removal member 25 provides a positive indicator to a consumer that a prize has been won, further heightening the anticipation and excitement produced by the prize award while the consumer pulls on removal member 25 to remove prize award 22 from its seated position. If desired, additional visual indicators or notices can be attached to the free end of removal member 25 in order to assure rapid visual identification of removal member 25 and the consumer notices a prize award is retained in straw 21.

In order to assure secret, undiscoverable retention of prize award 22 in randomly selected straws 21, straw 21 is enclosed within a suitably constructed outer closure/container 23. In the embodiment depicted in FIG. 1, outer closure/container 23 comprises a generally conventional wrapper which may be formed from a wide variety of materials. Preferably, such materials comprises one selected from the group consisting of foils, polymer films or sheets, heavy wrapping paper, fiber reinforced paper, and cardboard.

Regardless of the type of material employed for the wrapper form of outer closure/container 23, the material employed must be sufficiently dense or thick, as well as opaque, so as to prevent anyone from being able to visually or physically examine straw 21 and determine whether or not prize award 22 is retained therein. In this way, assurance is provided that no individual will be able to determine in advance whether a prize award is retained in any particular straw, prior to receiving that straw as part of a food purchase.

In order to attain successful, undiscoverable, random distribution of delivery system 20 with prize award 22 retained in straw 21, without prize award 22 being discovered prior to opening thereof, all of the straws distributed by the retail outlet are manufactured in a visually identical manner, incorporating the identical outer closure/container 23. In this way, all straws being distributed are visually identical and individuals will be incapable of analyzing the straws in advance to determine which particular straw contains prize award 22. As a result, the receipt of a prize bearing delivery system 20 of the present invention by a consumer is completely random, with each consumer having an equal chance of success in attaining a prize award. In this way, added excitement, interest, and winning anticipation is produced by the present invention.

Furthermore, in carrying out the present invention, it is preferred that both prize bearing straws and non-prize bearing straws are manufactured simultaneously, with the prize bearing straws being randomly seeded with the non-prize bearing straws, consistent with the desired ratio. As a result, total random distribution of prize bearing straws to consumers is achieved as part of their purchase of a fountain product.

In the embodiment depicted in FIG. 2, prize award 22 is retained in straw 21 in a manner substantially identical to the manner detailed above in reference to FIG. 1. Furthermore, as detailed above, removal member 25 is preferably employed, with one end of removal member 25 securely affixed to prize award 22, while the opposed end of removal member 25 extends outwardly from straw 21, ready to be accessed by the user when straw 21 is removed from outer closure/container 23.

In the embodiment shown in FIG. 2, outer closure/container 23 comprises an elongated tube consisting of telescopically engagable, mating sections 27 and 28. In the preferred construction, mating tube sections 27 and 28 comprise rigid, heavy, opaque material in order to prevent anyone from being able to determine if prize award 22 is present within straw 21, without separating sections 27 and 28. Preferably, sections 27 and 28 comprise cardboard, heavy paper, plastic or the like.

Furthermore, regardless of the material employed in constructing tube forming sections 27 and 28, sections 27 and 28 peripherally surround and encase straw 21 in a manner which prevents any individual from being able to determine whether straw 21 incorporates prize award 22. In this way, prize bearing straw 21 is retained in tube forming sections 27 and 28 for being randomly seeded with non-prize bearing straws mounted in similar tube sections, all distributed in the normal manner. In this way, lucky customers will randomly receive prize bearing straw 21 in sections 27 and 28 and experience the excitement and interest generated upon removal of prize bearing straw 21 from sections 27 and 28. Once straw 21 is withdrawn from sections 27 and 28, the lucky consumer will see removal member 25, with any associated indicia attached thereto, as the immediate indicator that prize 22 is present in straw 21, ready for removal and enjoyment by the consumer.

In the preferred embodiment, in order to preserve the integrity of cooperating tube sections 27 and 28 and be certain that no individual, including employees, are able to investigate the supply of straws to determine which straws contain a prize award, sections 27 and 28 are sealingly interconnected by fastening means 29. Preferably, fastening means 29 peripherally surround the entire outer peripheral surface of each section 27 and 28, sealingly and integrally telescopically interconnecting section 27 and 28 together. In this way, dislocation or separation of sections 27 and 28 is prevented.

Furthermore, if any separation of sections 27 and 28 were to occur, the separation would be immediately apparent, since the integrity of fastening means 29 would be destroyed. Consequently, unwanted opening of sections 27 and 28 by an individual is prevented and the desired random distribution of prize bearing straws with non-prize bearing straws is assured.

In this embodiment, all of the straws being distributed during the promotional time period would be manufactured in the identical manner. Consequently, all straws being distributed during the promotional contest would comprise straws mounted within tube forming sections 27 and 28.

In this way, each and every delivery system 20 is visually identical in appearance, weight, and feel, with no one delivery system 20 being capable of being analyzed by any individual as the particular delivery system 20 in which prize award 22 is contained. As a result, the precisely desired random distribution of prize bearing straws with non-prize bearing straws is efficiently attained and all of the features and consumer excitement generated by the prize delivery system of the present invention are realized.

In FIGS. 3–10, further alternate embodiments of the present invention are depicted. In each of these embodiments, alternate constructions for prize bearing straw 21 are shown. However, since each of the alternate embodiments depicted in FIGS. 3–10 would be retained in outer closure/container 23 of the nature detailed in FIGS. 1 and 2 and described above, the outer closure/container 23 has not been repeated in FIGS. 3–10. Consequently, it is to be understood that each embodiment of a prize bearing straw 21 shown in FIGS. 3–10 and detailed below would preferably be distributed, secured and retained within an outer closure/container 23 as described above.

Figure 3:
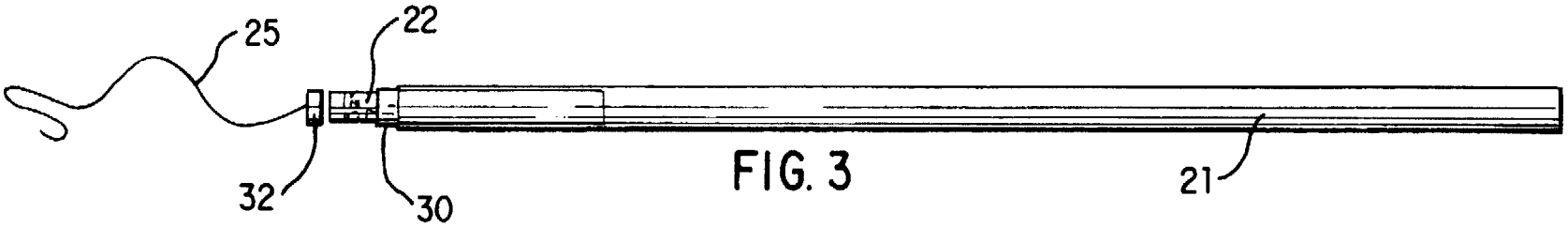
FIGS. 3–10 are all top plan views of further alternate embodiments for the drinking straw component of the delivery system of the present invention, with each embodiment being fully depicted in an alternate construction for the drinking straw of the delivery system of the present invention.

In FIG. 3, prize bearing straw 21 is constructed with an independent container 30 constructed for insertion within straw 21. Furthermore, as depicted in FIG. 3, prize award 22, depicted in the form of U.S. currency, would be rolled and inserted in container 30. In this embodiment, container 30 is cooperatively associated with a cap or cover 32, to which one end of removal member 25 is securely affixed.

In this way, cap or cover 32, which is constructed for mating interconnected engagement with container 30, provides complete sealing of prize award 22 in container 30 with container 30 being stored in straw 21. Once prize bearing straw 21 as depicted in FIG. 3 is inserted in a suitable outer closure/container 23, the resulting delivery system 20 is ready for random intermixing with non-prize bearing straw members and then distributed to the desired retail outlet for providing the promotional game or contest.

By employing container 30 with cap/cover 32 securely affixed thereto, the desired prize award 22 is securely retained in container 30 in a manner which prevents anyone from being able to determine the actual value of the prize award being won until container 30 has been removed from the straw 21. As a result, if desired, every straw 21 distributed to consumers during the promotional period may incorporate a container 30 with a coupon contained therein or a notice indicating that no prize has been won. This procedure is employed if advance discovery or destruction of delivery system 20 prior to distribution is likely to occur or if straws 21 are distributed without outer closure/container 23. However, in the preferred embodiment, only prize bearing straw members 21 incorporate container 30 so that upon removal of straw 21 from outer closure/container 23, the lucky consumer would immediately know that a prize award has been won.

By employing this embodiment, assurance is provided that container 30 is easily removed by the consumer by merely pulling on removal member 25. By pulling removal member 25, cap 32, with secured engagement to container 30, causes container 30 to be withdrawn from straw 21, thereby revealing container 30 and enabling the consumer to open container 30. Once cap 32 has been removed from container 30, access to the interior of container 30 is easily attained and the consumer is able to remove the prize award 22 contained therein.

Container 30 and cap 31 may be formed from a wide variety of various materials. Although virtually any desired material can be employed, it has been found that the material is preferably selected from the group consisting of plastics, heavy-duty paper, paper, cardboard, metal, metalized paper, cellophane, foils, and fiber-reinforced materials. In addition, if desired, cap 32 can be eliminated and removal means 25 can be securely affixed directly to either the inside wall or outside wall of container 30. In this way, removal means 25 would be positioned, as detailed above in reference to FIGS. 1 and 2, ready for being used by the consumer upon removal of straw 21 from outer closure/container 23.

Figure 4:
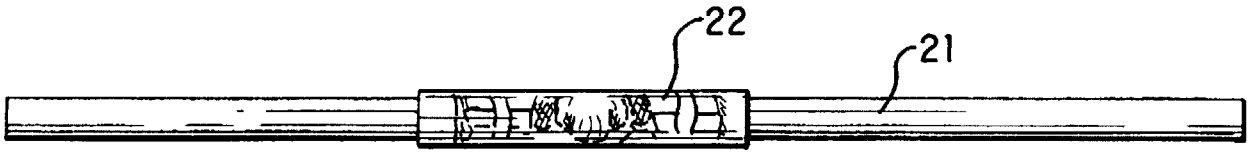

In FIG. 4, an alternate embodiment for delivering prize award 22 to consumers in association with drinking straw 21 is depicted. In this embodiment, prize award 22 is wrapped about the outer surface of straw 21 providing immediate visual notice to the consumer that prize award 22 has been won. As depicted, prize award 22 comprises U.S. currency. However, any alternate prize award can be employed without departing from the scope of this invention.

In the preferred construction, prize award 22 is secured to straw 21, employing food grade adhesive means. As detailed above, any desired adhesive can be employed for this purpose provided the adhesive is easily removable and meets all federal requirements for a consumable product.

In addition, or as an alternate construction, an overlay may be affixed to straw 21 peripherally surrounding and effectively concealing prize award 22. This overlay may also function as a removal member which assists in removing prize award 22 from straw 21.

By employing this embodiment of the present invention, immediate notice is provided to the consumer that a prize award has been won as well as immediate notice of the denomination of the prize award, when U.S. currency is employed as prize award 22. Furthermore, if any other desired prize award is employed, indicia can be printed on prize award 22 for immediate notification to consumers of the precise award received by the consumer. In such situations, pictures of stereos, cars, television sets, etc., can be printed on the exposed surface of prize award 22, thereby enabling consumers to immediately see the precise identification of the prize that has been won.

In employing this embodiment, it is important that outer closure/container 23, as discussed above in reference to FIGS. 1 and 2, is employed in order to assure that the existence of prize award 22 is concealed. If desired, non-prize awarding coupons can also be secured to the outer surface of straw 21 in order to simulate a prize award 22 and assure the integrity of the overall promotion. However, in the preferred construction, prize award 22 is securely affixed to straw 21 without the use of non-prize bearing simulated wrappers. In that way, prize award 22 is securely affixed to straw 21 and placed in outer closure/container 23 which prevents advance detection thereof. Then, the resulting prize delivery system 20 is randomly intermixed with nonprize bearing straw assemblies and distributed to consumers.

Figure 5:
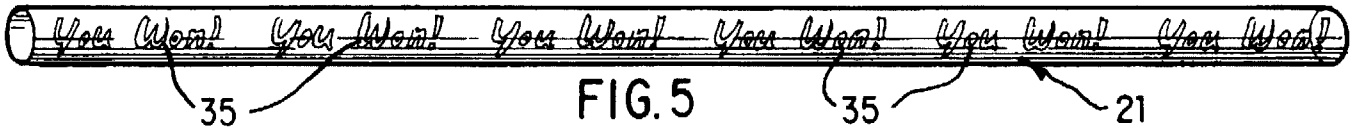
Figure 6:
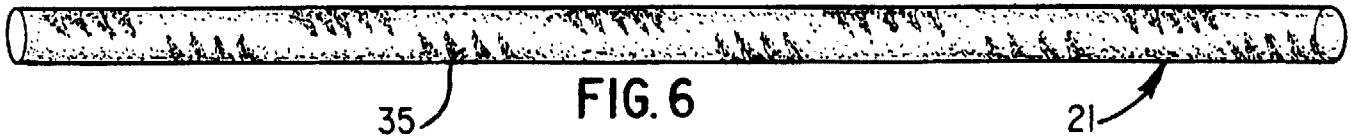
Figure 7:
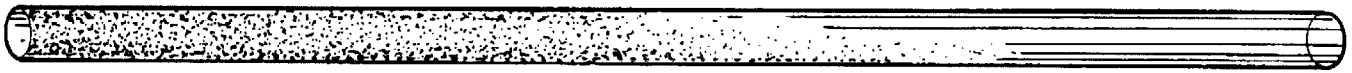

In FIGS. 5, 6, and 7, alternate embodiments of the present invention are depicted wherein prize bearing straw assembly 21 comprises temperature sensitive inks or dyes to produce particular visual effects indicating that a prize has been won. In FIG. 5, indicia 35 are printed on the outer surface of straw 21 with indicia 35 conveying a particular message to the recipient. As depicted, indicia 35 comprises the words "YOU WON". However, in carrying out this embodiment of the present invention, any desired indicia can be employed including indicia specifically identifying the prize award won by the consumer.

In employing this embodiment of the present invention, as well as the embodiments depicted in FIGS. 6 and 7, straw 21 visually appears identical to any conventional non-prize bearing straw. However, upon immersion of prize bearing straw 21 in either a hot or cold liquid, the temperature sensitive inks or dyes employed are activated, causing the inks to become visible. In the embodiment depicted in FIG. 5, indicia 35 is visible, indicating to a consumer that a prize has been won.

In the embodiment depicted in FIGS. 6 and 7, indicia 35 reveals a unique pattern or color to the consumer representing a winning, prize bearing straw. If desired, alternate color designs or pattern designs can be employed, representing different prize levels, all of which are posted or pre-announced. Similarly, in FIG. 7, a visually distinctive color pattern is represented by indicia 35 as the indicator that a prize has been won.

Figure 8:
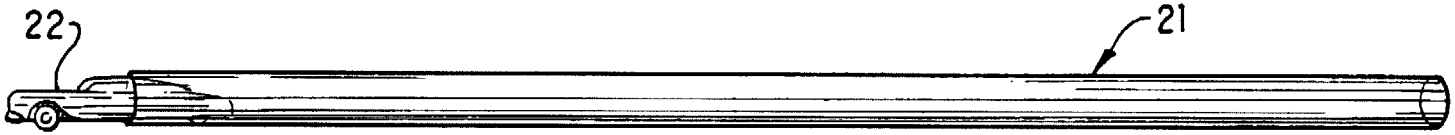
Figure 9:
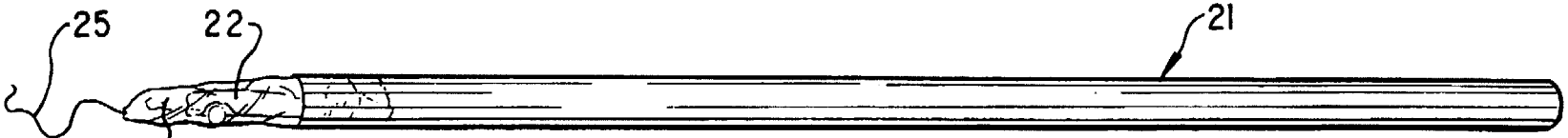

In FIGS. 8 and 9, two alternate embodiments of the present invention are depicted. In these embodiments, straw 21 comprises prize award 22 in the form of a miniature model representing a particular prize that has been won by the consumer. As shown in FIG. 8, prize award 22 is depicted in the form of an automobile, which has been inserted in the interior of straw 21 for being revealed to the consumer upon removal of straw 21 from outer closure/container 23. In this embodiment, any other prize award can be visually represented by any miniature model, thereby immediately revealing to the consumer the prize that has been won to produce the desired level of interest and excitement in the promotional contest.

In FIG. 9, an embodiment similar to FIG. 8 is depicted, wherein prize award 22 comprises a model of an automobile. However, in this embodiment, prize award 22 is peripherally surrounded and encased within outer container 37, similar in construction and nature to container 30 detailed above in reference to FIG. 3. In this embodiment, removal means 25 is affixed at one end thereof to container 37 in order to enable container 37 and prize award 22 to be quickly and easily removed from its stowed position within straw 21.

As detailed above, container 37 may be formed from any desired material which will produce the desired effect. Such materials include cellophane, foil, plastics, cardboard, paper, and the like. However, these materials are not exhaustible of the type of material that can be employed and any other suitable material can be used for container 37.

Figure 10:
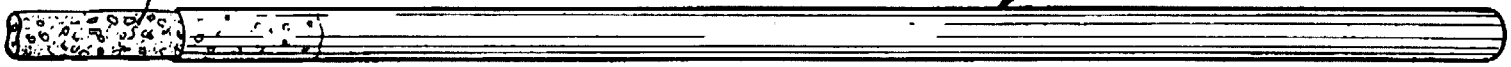

In FIG. 10, another alternate embodiment of the present invention is depicted. In this embodiment, prize bearing straw 21 incorporates prize award 22 in the form of a food grade or FDA approved compressed sponge member. As is well known in the art, sponge members may be formed in any desired configuration and then compressed to a small, compact size and shape. However, once this sponge member is exposed to any liquid material, the sponge member expands and returns to its original shape.

By employing this embodiment, prize award 22 is formed in a configuration of a prize award, such as in the configuration of a car, TV set, stereo, boat, and the like. These pre-formed sponge members are compressed, using known technology, and when fully compressed, the resulting sponge member is inserted in straw 21, representing prize award 22.

Once a consumer withdraws straw 21 from the outer closure/container 23 within which straw member 21 is retained, the consumer immediately sees prize award 22 and places prize member 22 is suitable liquid. The absorption of a liquid by sponge member 22 causes the sponge member to expand into the desired shape, immediately revealing to the consumer the prize that has been won.

If desired, prize award 22, as depicted in FIG. 10, can be wrapped in any suitable container, such as container 30 or 37 as discussed above. In addition, removal means 25 can be affixed directly to the sponge member form of prize award 22 or, alternatively, to the container within which sponge member prize award 22 is configured. In this way, greater control over the removal of prize award 22 is attained, as well as a higher level of assurance that all consumable surfaces are in contact with appropriate bacteria free materials.

It is intended that a consumer would remove sponge member prize award 22 prior to inserting straw 21 into the appropriate liquid. However, in the embodiment depicted in FIG. 10, wherein sponge member prize award 22 is placed within the interior surface of straw 21 without a peripherally surrounding covering or container, a consumer is able to discover the prize award even if the presence of prize award 22 is not observed by the consumer. In this regard, sponge member prize award 22 would begin to expand immediately upon having straw member 21 inserted into the liquid associated with the drink purchased by the consumer. Consequently, upon being exposed to the liquid, sponge forming prize award 22 would begin to expand, automatically emerging from straw 21 as sponge forming prize award 22 expands into its original non-compressed configuration. In this way, a consumer who does not observe the presence of sponge forming prize award 22 would be immediately informed that a prize had been won as sponge forming prize award 22 expands into the particular shape, such as a boat, car, TV set, etc. and is observed in the liquid drink with which straw 21 was originally associated.

By employing this embodiment of the present invention, a further construction is attained whereby consumers are immediately informed of the prize award that has been won in a unique, exciting manner simultaneously with the purchase of the item. As a result, substantial interest, excitement, and direct involvement of the consumer with the prize awarding system is attained and retail outlets employing the present invention are capable of enjoying the highly advantageous commercial success realized by this promotional vehicle.

It will thus be seen that the object set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described my invention, what I claim is new and desire to secure by Letters Patent is:

1. A prize delivery system for randomly distributing a prize award with non-prize bearing drinking straws while preventing detection of a prize by any individual prior to the opening thereof, said prize delivery system comprising:

A. an elongated, substantially cylindrically shaped drinking straw;

B. a prize award mounted in association with the drinking straw for retention therewith;

C. covering means peripherally surrounding and enclosing the drinking straw and prize award, preventing visual and physical examination of the drinking straw contained therein to determine the presence of a prize award without the opening thereof; and D. removal means cooperatively associated with the prize award for providing easy removal of the prize award from the straw;

whereby a prize delivery system is attained wherein a prize award is secretly concealed in association with a drinking straw, with the presence of the prize award being completely undiscoverable when compared with non-prize bearing, conventional drinking straws, thereby enabling the random distribution of prize bearing straws with non-prize bearing straws, with complete assurance that the presence of a prize award is discovered by consumers only upon opening of the prize delivery system.

2. The prize delivery system defined in claim 1, wherein said covering means is further defined as comprising one selected from the group consisting of paper, plastic, foil, cardboard, metal, and fiber-reinforced materials.

3. The prize delivery system defined in claim 2, wherein said covering means is further defined as peripherally surrounding and completely enclosing the drinking straw and prize award so as to prevent the unwanted manipulation thereof to distinguish prize bearing drinking straws from nonprize bearing drinking straws.

4. The prize delivery system defined in claim 3, wherein said covering means is further defined as comprising an elongated tube incorporating a. two telescopically engaged sections peripherally surrounding and securely enclosing the drinking straw, and b. sealing means peripherally surrounding and sealingly interconnecting said telescopically engaged members, preventing unwanted separation or tampering thereof.

5. The prize delivery system defined in claim 1, wherein the prize award is further defined as being mounted within the inside wall of the drinking straw and said removal means is further defined as comprising an elongated strip of material with one end thereof securely affixed to the prize award and the opposed end thereof positioned in association with the outside wall of the drinking straw, thereby enabling the consumer to quickly and easily remove the prize award from it s position within the drinking straw.

6. The prize delivery system defined in claim 5, wherein said strip of material forming the removal means is further defined as comprising one selected from the group consisting of string, foil, cellophane, plastic, cardboard, paper, metal, and fiber-reinforced materials.

7. The prize delivery system defined in claim 5, wherein said prize award is further defined as being securely mounted within the interior wall of the straw by employing food grade adhesive means.

8. The prize delivery system defined in claim 5, wherein said prize award is further defined as being peripherally surrounded and enclosed by a protective covering with said prize award and covering being positioned in association with the inside wall of the drinking straw.

9. The prize delivery system defined in claim 8, wherein said cover/container of said prize award is further defined as being formed from one material selected from the group consisting of paper, plastic, foil, cellophane, cardboard, metal, and fiber-reinforced materials.

10. The prize delivery system defined in claim 8, wherein said prize container is further defined as being formed in a substantially cylindrical tubular shape, with said prize award positioned within the elongated cylindrical tube and said container is further defined as comprising cap or cover means removably associated with the container for providing access to the container and the prize award once removed from the drinking straw.

11. The prize delivery system defined in claim 10, wherein said removal means is further defined as being associated with the cap of said container for assuring ease of removal of said container and prize award when desired by the consumer.

12. The prize delivery system defined in claim 1, wherein said prize award is further defined as being mounted in peripherally surrounding association with the outside wall of the drinking straw and said removal means is mounted in direct association with the prize award for assisting in the removal of the prize award therefrom.

13. The prize delivery system defined in claim 12, wherein said prize award is securely maintained in position in association with the outside wall of the drinking straw by employing food grade adhesive means.

14. The prize delivery system defined in claim 1, wherein said prize award is further defined as comprising one selected from the group consisting of U.S. currency, coupons, and miniatures models of the prize being won.

15. The prize delivery system defined in claim 1, wherein said prize award is further defined as comprising a food compatible, compressed sponge inserted into the interior of the straw and being constructed in a shape representing the prize award being won, said shape being revealed upon exposure of the sponge to liquid.

16. A prize delivery system for randomly distributing a prize award with non-prize bearing drinking straws while preventing detection of a prize by any individual prior to the opening thereof, said prize delivery system comprising:

A. an elongated, substantially cylindrically shaped drinking straw formed with food grade, temperature sensitive inks or dyes responsive to exposure to hot or cold liquids to produce prize indicating indicia on the straw; and B. covering means peripherally surrounding and enclosing the drinking straw and prize award, preventing visual and physical examination of the drinking straw contained therein to determine the presence of a prize award without the opening thereof; and whereby a prize delivery system is attained wherein a prize award is secretly concealed in association with a drinking straw, with the presence of the prize award being completely undiscoverable when compared with non-prize bearing, conventional drinking straws, thereby enabling the random distribution of prize bearing straws with non-prize bearing straws, with complete assurance that the presence of a prize award is discovered by consumers only upon opening of the prize delivery system.

17. The prize delivery system defined in claim 16, wherein said indicia is further defined as comprising one selected from the group consisting of words, phrases, colors, stripes, symbols, and pictures.

* * * * *